US011044962B2

(12) United States Patent
Cheung

(10) Patent No.: US 11,044,962 B2
(45) Date of Patent: Jun. 29, 2021

(54) MODULAR SHOES WITH ADJUSTABLE SIZE

(71) Applicant: Hon Man Cheung, Hong Kong (HK)

(72) Inventor: Hon Man Cheung, Hong Kong (HK)

(73) Assignee: Hon Man Cheung, Hong Kong (HK)

( * ) Notice: Subject to any disclaimer, the term of this patent is extended or adjusted under 35 U.S.C. 154(b) by 32 days.

(21) Appl. No.: 16/450,833

(22) Filed: Jun. 24, 2019

(65) Prior Publication Data

US 2020/0375301 A1 Dec. 3, 2020

(51) Int. Cl.

| | |
|---|---|
| ***A43B 3/26*** | (2006.01) |
| ***A43B 3/24*** | (2006.01) |
| ***A43B 23/02*** | (2006.01) |
| ***A43B 13/16*** | (2006.01) |

(52) U.S. Cl.

CPC ..... *A43B 3/26* (2013.01); *A43B 3/246* (2013.01); *A43B 13/16* (2013.01); *A43B 23/0295* (2013.01)

(58) Field of Classification Search

CPC ..... A43B 3/26; A43B 3/246; A43B 5/04427; A43B 3/30; F16B 23/0076; F16B 23/0092; F16B 35/06

USPC ..... 36/97

See application file for complete search history.

(56) References Cited

U.S. PATENT DOCUMENTS

| | | | | |
|---|---|---|---|---|
| D573,259 | S * | 7/2008 | Park | F16B 23/00 D24/156 |
| 8,869,434 | B2 * | 10/2014 | Peraro | A43B 3/26 36/97 |
| 2005/0254921 | A1 * | 11/2005 | Leblanc | F16B 23/00 411/409 |

* cited by examiner

*Primary Examiner* — Clinton T Ostrup
*Assistant Examiner* — Matthew R Marchewka
(74) *Attorney, Agent, or Firm* — Timothy T. Wang; Ni, Wang & Massand, PLLC

(57) ABSTRACT

A modular adjustable shoe includes a sole forefoot, a sole surface, a connecting block, a first fastening part, a second fastening part, a sole heel and a heel surface; the sole surface is on the sole forefoot, the heel surface is on the sole heel, the connecting block is on one side of the sole forefoot near the sole heel, the side of the sole heel near the sole forefoot has a connecting groove, the connecting block is connected to and matches the connecting groove, there are a number of first fastening holes evenly distributed on the connecting block, the sole heel has second fastening holes, both the first fastening part and second fastening part respectively go through first fastening holes and second fastening holes, and the first fastening part and the second fastening part are fastened and connected.

4 Claims, 5 Drawing Sheets

MODULAR SHOES WITH ADJUSTABLE SIZE

FIELD

The present disclosure is generally related to shoes, particularly a type of modular adjustable shoes.

BACKGROUND

Currently, shoes in the market are produced with specified sizes, and different people will choose different sizes of shoes that fit. When one gets shoes that don't fit or with a wrong size, he can only return the shoes or give them up, and has to assume an additional cost to replace the shoes that cannot be used at all. What's more, as children keep growing, they often need new suitable shoes to keep with the growth of their feet. As they grow quickly, their shoes have to be discarded even if they are brand-new, resulting in the waste of resources and the increase of cost; besides, the discarded shoes may cause environmental problems.

Currently, shoes are usually designed in an integrated manner. Once the shoes are completed, the design form and pattern of the shoes may not be changed. As a result, the concept of design of the shoes cannot vary significantly, and a huge stock may be generated in the course of production. In addition, integrated shoe designs generally target one specific season of the year and cannot he used in different seasons. For example, shoes designed for summer are generally not wearable during winter.

In one embodiment, a modular adjustable shoe comprising at least one of a sole forefoot, a sole heel proximate the sole forefoot having a connecting groove and having at least one second fastening hole, a connecting block connected to the sole forefoot proximate the sole heel and complementary to the connecting groove, the connecting block has a plurality of first fastening holes, the at least one second fastening hole alignable to at least one of the plurality of first fastening holes, a first fastening part and a second fastening part connectable to the first fastening part, wherein the first fastening part and the second fastening part are respectively connected through one of the plurality of first fastening holes and the at least one second fastening hole.

Figure 1:
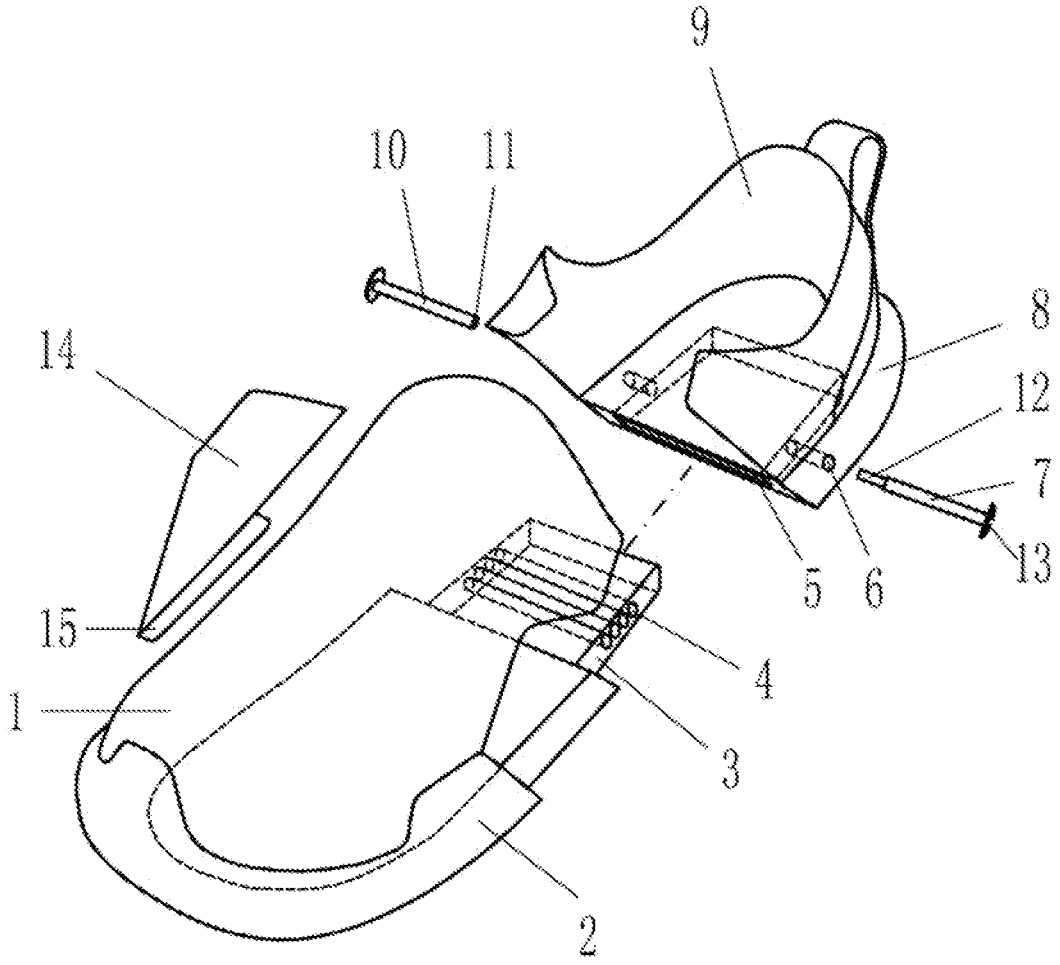
FIG. 1 is a first perspective structure schematic view of one example in accordance with an embodiment of the disclosure.

The marks in the attached figures are: 1—sole surface, 2—sole forefoot, 3—connecting block 4—first fastening hole, 5—connecting; groove, 6—second fastening hole, 7—first fastening part, 8—sole heel, 9—heel surface, 10—second fastening part, 11—threaded hole, 12—screw, 13—rotator, 131—beeline-shaped groove, 132—arc-shaped groove, 14—shielding piece, 15—connecting piece, 16—first protruding part, 17—second protruding part, and 18—connecting part.

DETAILED DESCRIPTION

It may be readily understood that the components of the present application, as generally described and illustrated in the figures herein, may be arranged and designed in a wide variety of different configurations. Thus, the following detailed description of the examples of a method as represented in the attached figures is not intended to limit the scope of the application as claimed, but is merely representative of selected examples of the application.

The features, structures, or characteristics of the application described throughout this specification may be combined in a suitable manner in one or more examples. For example, the usage of the phrases example, examples, some examples, or other similar language, throughout this specification refers to the fact that a particular feature, structure, or characteristic described in connection with the example may be comprised in at least one example of the present application. Thus, appearances of the phrases example, examples, in some examples, in other examples, or other similar language, throughout this specification does not necessarily refer to the same group of examples, and the described features, structures, or characteristics may be combined in a suitable manner in one or more examples.

For the foregoing issues, one technical issue that may be solved in this utility model is to provide a modular design, where the shoe is divided into the sole forefoot and the heel. The two parts, through a simple stitching structure, can realize an adjustment to the size, change the shoe to go with clothes, and realize a type of modular adjustable shoes at a lower cost.

This utility model may be realized by an example technical means:

A type of modular adjustable shoes, including a sole forefoot, a sole surface, a connecting block, a first fastening part, a second fastening part, a sole heel and a heel surface; the sole surface is on the sole forefoot, the heel surface is on the sole heel, the connecting block is on one side of the sole forefoot near the sole heel, the side of the sole heel near the sole forefoot has a connecting groove, the connecting block is connected to and matches the connecting groove, there are a number of first fastening holes evenly distributed on the connecting block, the sole heel has second fastening holes, both the first fastening part and second fastening part respectively go through first fastening holes and second fastening holes, and the first fastening part and the second fastening part are fastened and connected.

Furthermore, it may also include a screw and rotators. The screw is on one end of the first fastening part; there is a threaded hole on one end of the second fastening part. The screw is connected to the thread of the threaded hole. Rotators are placed on both the end of the first fastening part opposite the screw and the end of the second fastening part opposite the screw.

Furthermore, the rotator has a beeline-shaped groove, and there are arc-shaped grooves on both sides of the beeline-shaped groove.

Furthermore, the modular adjustable shoe set forth as an example is characterized by the fact that it may also include a shielding piece, a connecting piece, a first protruding part and a second protruding part. The shielding part is connected to the sole forefoot via the connecting piece. The first protruding part is connected to the heel surface as a whole.

The second protruding part is connected to the sole surface as a whole. The first protruding part is between the shielding piece and the second protruding part.

Furthermore, the modular adjustable shoe set forth as an example is characterized by the fact that there is a connecting piece between the first protruding part and the second protruding part.

Compared to current techniques, this utility model has the following beneficial effect:

This utility model realizes flexible assembly. The shoe size may be adjusted according to the foot size, so that not only the shoes can be used for longer time, but the production problem of one shoe with only one size can also be solved; it can effectively reduce production stock, and the modular production can enhance the production efficiency at the same time.

The length of the shoe may be adjusted as needed for size through the movement of the relative position of the connecting block and the connecting groove, which solves the problem that shoe size cannot be adjusted.

The sole forefoot of the shoe is designed separately with the sole heel. The two parts can be produced separately for the enhancement of the production efficiency. Besides, either part can be bought separately, so that it is not necessary to discard the entire shoe when it is damaged. Further, shoes with the present modular design can be used for all seasons. All the user has to do is changing the heel surface for the proper season. This solve the seasonal limit for integrated shoe designs and improved the utility of the shoe.

The modular design may realize the combination of the two parts of the shoe in different styles as you like. In this way, not only the shoe size can be adjusted, but also the form of use of the shoe can vary; the design concept is thus further enhanced.

Figure 2:
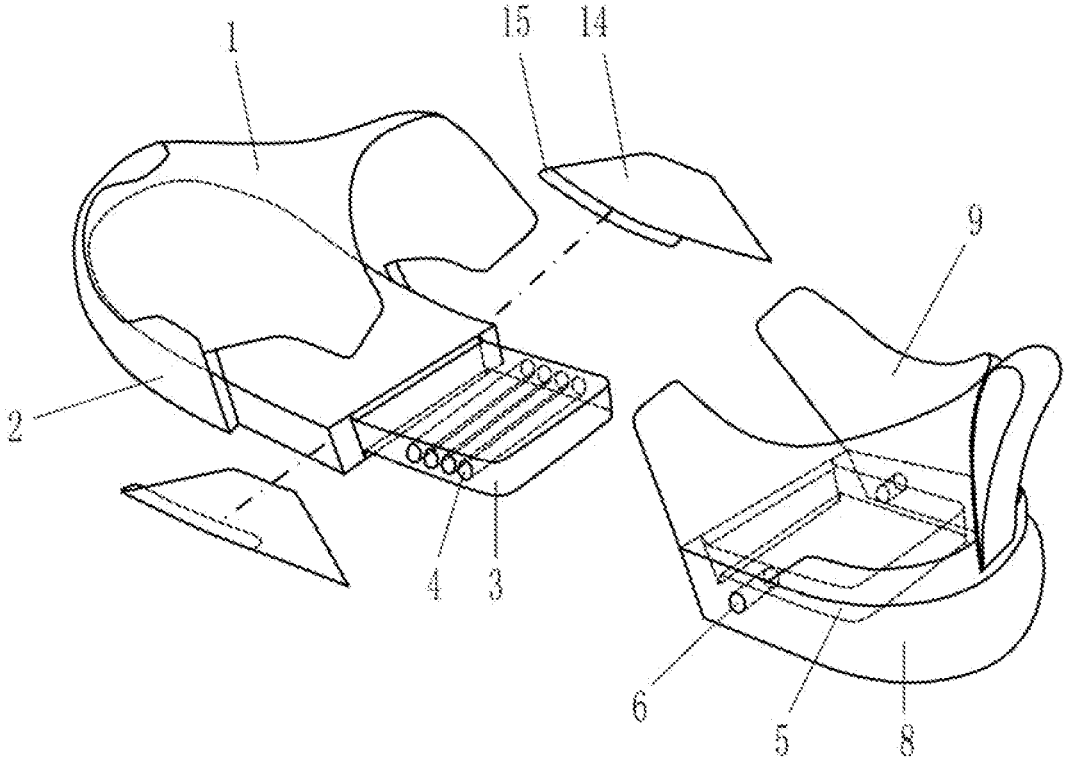
FIG. 2 is a second perspective structure schematic view of one example in accordance with an embodiment of the disclosure.
Figure 3:
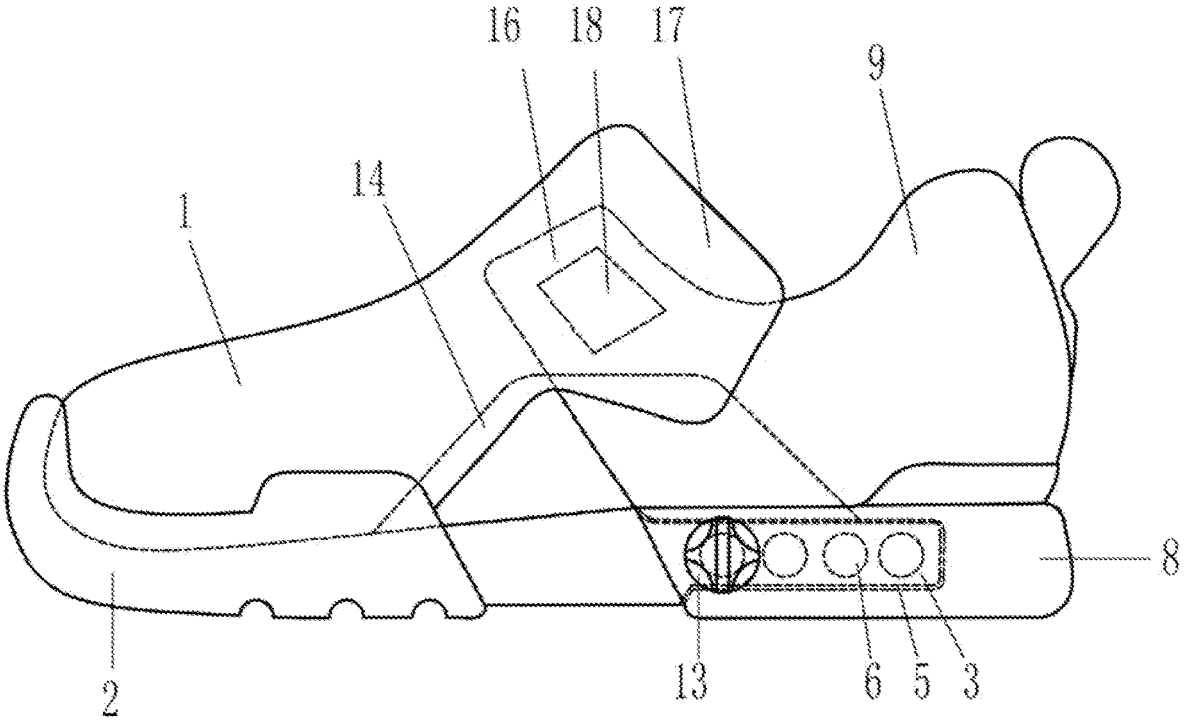
FIG. 3 is a schematic front view of one example in accordance with an embodiment of the disclosure.

As shown in FIGS. 1-3, A type of modular adjustable shoes, including the sole forefoot 2, the sole surface 1, the connecting block 3, the first fastening part 7, the second fastening part 10, the sole heel 8 and the heel surface 9; the sole surface 1 is on the sole forefoot 2, the heel surface 9 is on the sole heel 8, the connecting block 3 is on one side of the sole forefoot 2 near the sole heel 8, the side of the sole heel 8 near the sole forefoot 2 has a connecting groove 5, the connecting block 3 is connected to and matches the connecting groove 5, there are a number of first fastening holes 4 evenly distributed on the connecting block 3, the sole heel 8 has second fastening holes 6, both the first fastening part 7 and second fastening part 10 respectively go through first fastening holes 4 and second fastening holes 6, and the first fastening part 7 and the second fastening pan 10 are fastened and connected.

In the foregoing structure, the connecting block 3 is inserted into the connecting groove 5. The connecting block 3 is moves in the connecting groove 5 as needed for the shoe size. When the shoe size is confirmed, the second fastening holes 6 will be connected with the first fastening holes 4; the first fastening part 7 and the second fastening part 10 can be inserted into the first fastening holes 4 and the second fastening holes 6 from both sides and then the first fastening part 7 and the second fastening part 10 will be connected and fastened. Through such operation, the connecting block 3 and the connecting groove 5 can be fastened, and the shoe size can be fixed at the position after the choice is made, realizing the easy adjustment to the shoe size.

Furthermore, it also includes the screw 12 and the rotator 13. The screw is on one end of the first fastening part 7; there is a threaded hole 11 on one end of the second fastening, part 10. The screw 12 is connected to the thread of the threaded hole 11. Rotators 13 are placed on both the end of the first fastening part 7 far from the screw 12 and the end of the second fastening part 10 far from the screw 11.

In the fastening of the first fastening part 7 and the second fastening part 10, the rotator 13 is rotated, and the rotator 13 drives the first fastening part 7 and the second fastening part 10 to rotate, so that the screw 12 will be rotated into the threaded hole 11. Then the effect of the first fastening part 7 and the second fastening 10 can be finally realized.

Figure 4:
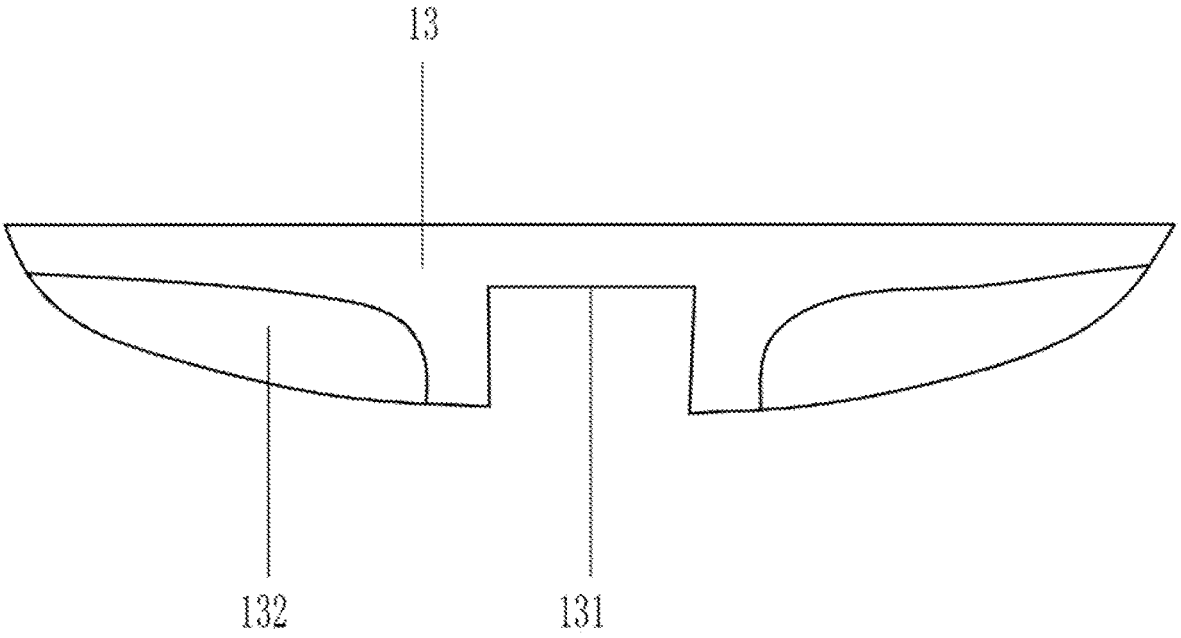
FIG. 4 is a schematic front view of the structure of the rotating body of one example in accordance with an embodiment of the disclosure.
Figure 5:
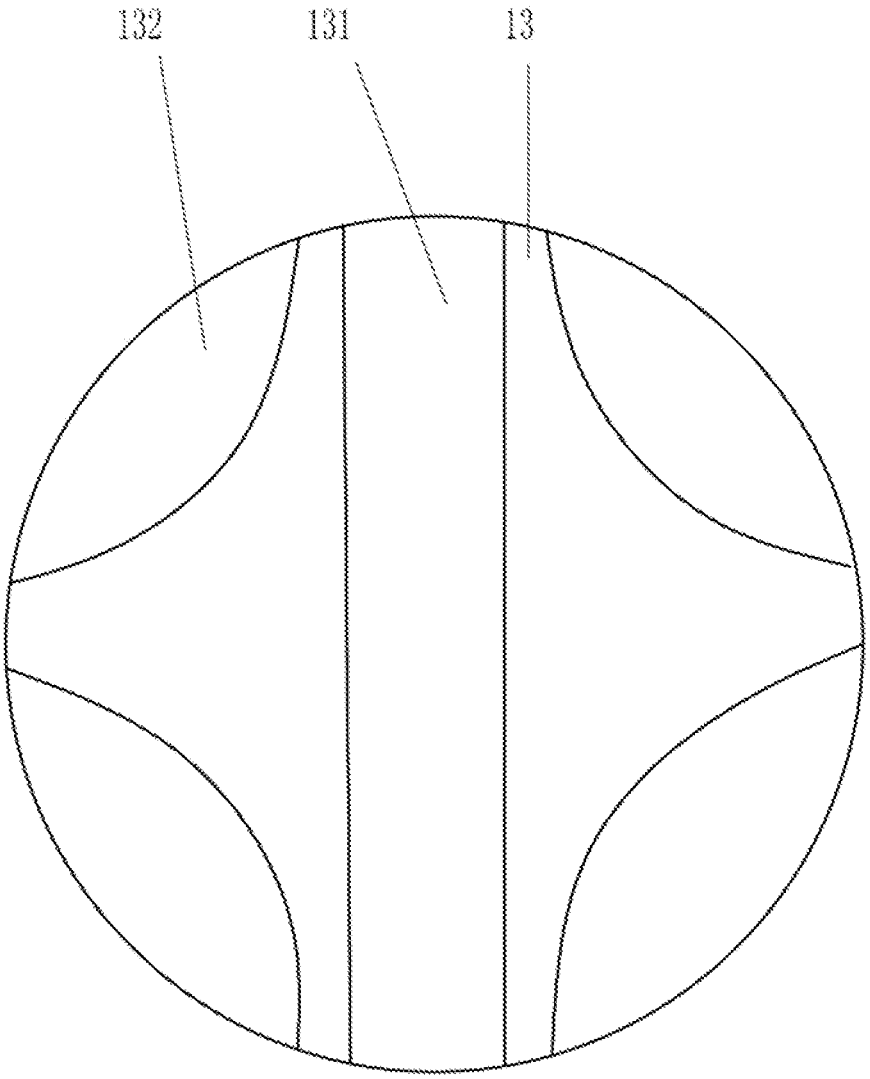
FIG. 5 is a schematic top view of the rotator of one example in accordance with an embodiment of the disclosure.

Furthermore as shown in FIG. 4-5, the rotator 132 has a beeline-shaped groove 131, and there are arc-shaped grooves 132 on both sides of the beeline-shaped groove 131.

The design of the arc-shaped grooves 132 (FIG. 4 and FIG. 5) allows rotator 13 to better exert force. When the first fastening part 7 and the second fastening part 10 need to be completely locked, a coin or any other beeline-shaped article may be pushed into the beeline-shaped groove 131 (FIG. 4 and FIG. 5). Then the rotator 13 can rotate with full leveraging, and thus exerting force on the first fastening part 7 and the second fastening part 10 so that they can be completely locked.

Furthermore, it also includes a shielding piece 14, a connecting piece 15, a first protruding part 16 and a second protruding part 17. The shielding part 14 is connected to the sole forefoot 2 via the connecting piece 15. The first protruding part 16 is connected to the heel surface 9 as a whole. The second protruding part 17 is connected to the sole surface 1 as a whole. The first protruding part 16 is between the shielding piece 14 and the second protruding part 17.

With the design of the first protruding pan 16 and the second protruding part 17, when the shoe size is changed, the sole forefoot will not be separated from the heel surface 9, instead, the sole forefoot 2 always keeps close to the heel surface, realizing protection, practicability and good appearance.

Furthermore, there is a connecting piece 18 between the first protruding part 16 and second protruding part 17. When the shoe size is changed, there will be a relative movement between the first protruding part 16 and the second protruding part so that the two components can be separated from each other. After the adjustment to the shoe size is done, the connecting part 18 will be fastened, so that the first protruding part 16 and the second protruding part 17 can keep fully close to each other, so that the shoe will be not become unsuitable because the two components are likely to move.

The heel surface 9 can be made for a sandal. During the hot and humid days in summer, one can keep the sole forefoot 2, separate the connecting piece 15 from sole forefoot 2, take out the shielding part 14 to increase the ventilation of the shoe, then combine a sole heel 8 designed for sandals with sole forefoot 2 to form a shoe suitable for summer. Therefore, shoes designed with the current modular design can be suitable for different seasons.

The foregoing are descriptions of this application with the specific embodiment methods. However, technicians in this field should have been aware that all such descriptions are for example only, and rea not a limitation to the scope of protection of this application. Technicians in this field can make various variables and modifications to this application according to the spirit and law of this application, and such variables and modifications also fall within the scope of this application.

Although exemplary examples the method of the present disclosure have been illustrated in the accompanied drawings and described in the foregoing detailed description, it will be understood that the application is not limited to the examples disclosed, and is capable of numerous rearrangements, modifications, and substitutions without departing from the spirit or scope of the disclosure as set forth and defined by the following claims.

The above examples are for illustrative purposes and are not intended to limit the scope of the disclosure or the adaptation of the features described herein to particular components. Those skilled in the art will also appreciate that various adaptations and modifications of the above-described preferred examples may be configured without departing from the scope and spirit of the disclosure. Therefore, it is to be understood that, within the scope of the appended claims, the disclosure may be practiced by examples in addition to those specifically described.

What is claimed is:

1. A modular adjustable shoe, comprising:

a sole forefoot;

a sole heel proximate the sole forefoot having a connecting groove and having at least one second fastening hole;

a connecting block connected to the sole forefoot proximate the sole heel and complementary to the connecting groove and inserted into the connecting groove, the connecting block has a plurality of first fastening holes, the at least one second fastening hole alignable to at least one of the plurality of first fastening holes, wherein the connecting block is within, matches and is complementary to the connecting groove throughout the connection to the connecting groove;

a first fastening part;

a second fastening part connectable to the first fastening part, wherein the first fastening part and the second fastening part are respectively connected through one of the plurality of first fastening holes and the at least one second fastening hole;

at least one removably reattachable shielding piece;

a connecting piece connecting the removably reattachable shielding piece to the sole forefoot;

a second protruding part connected to a sole surface; and a first protruding part connected to a heel surface wherein the first protruding part is located between the at least one removably reattachable shielding piece and the second protruding part.

2. The modular adjustable shoe of claim 1 further comprising a screw inserted in the first fastening part; and the second fastening part having a threaded hole therein engagably coupling the first fastening part; and a plurality of rotators located at the first fastening part distal from the screw and at the second fastening part distal from the screw.

3. The modular adjustable shoe of claim 2 wherein the plurality of rotators have a beeline-shaped groove with arc-shaped grooves on two sides of the beeline-shaped groove.

4. The modular adjustable shoe of claim 1 wherein the connecting piece is boated between the first protruding part and the second protruding part.

* * * * *